US006157350A

United States Patent [19]

House et al.

[11] Patent Number: 6,157,350

[45] Date of Patent: Dec. 5, 2000

[54] ANTENNA LATCHING MECHANISM

[75] Inventors: Kevin Duane House, Gilbert; Javier Leija, Chandler; Ronald James Nordhues, Gilbert; Jay Robert Mitchell, Mesa; Matthew Ronald Michieli, Gilbert, all of Ariz.

[73] Assignee: Motorola, Inc., Schaumburg, Ill.

[21] Appl. No.: 09/414,467

[22] Filed: Oct. 7, 1999

[51] Int. Cl.[7] ..... H01Q 1/50

[52] U.S. Cl. ..... 343/906; 343/702; 439/916

[58] Field of Search ..... 343/702; 439/906, 439/916, 915, 692, 693, 694, 695, 696, 489

[56] References Cited

U.S. PATENT DOCUMENTS 5,151,047 9/1992 Phillips ..... 439/333
5,576,720 11/1996 Gorenz, Jr. et al. ..... 343/702
5,647,757 7/1997 Chrysostomou ..... 439/352
5,714,963 2/1998 Cox ..... 343/786
5,949,386 9/1999 Elliott ..... 343/906

*Primary Examiner*—Hoanganh Le
*Assistant Examiner*—Trinh Vo Dinh
*Attorney, Agent, or Firm*—Frank J. Bogacz

[57] ABSTRACT

An antenna latching mechanism includes a housing with an attached antenna and a mating utility part. A collar is formed on one of the housing and the utility part and a mating stem, rotatably fitting within the collar, is formed on the other. The collar and stem define an opening and a ridge is formed in the opening. Flexible fingers, each having a cam surface, are positioned on one of the housing and the utility part to extend through the opening, with the stem coaxially positioned in the collar, so the cam surfaces engage the ridge in a releasable assembled orientation. Detent notches are defined in one of the collar and stem and a mating flexible detent finger is formed in the other to engage a selected one of the notches and provide a plurality of stable axial positions of the housing relative to the mating utility part.

25 Claims, 2 Drawing Sheets

ANTENNA LATCHING MECHANISM

FIELD OF THE INVENTION

This invention relates apparatus for attaching an antenna to a telephone or the like.

More particularly, the present invention relates to apparatus for attaching an antenna to a telephone or the like and for positioning the antenna relative to the telephone or the like.

BACKGROUND OF THE INVENTION

At the present time there are a large variety of utilities, such as telephones, cellular telephones, radios, and other communications devices that use antennas to receive and send communications signals. In some instances the position of the antenna, relative to the direction from which the signal is being received, can greatly enhance the reception of the signal. In hand sets which are held adjacent to the ear and mouth, for example, it may be desirable for the antenna to be directed in a nearly (or as nearly as practical) vertical direction during use to better receive vertically polarized signals. In cases where the antenna extends directly out of the utility, it may be impractical to bend the head sufficiently to orient the antenna vertically.

To overcome this problem, the prior art has provided antennas on some utilities which are angularly rotatable relative to the utility. The problem is that many of these devices incorporate relatively complicated structures or assemblies to attach the antenna to the utility. For example, in one device leaf springs are incorporated to close a latch plate onto the mating antenna part. This type of device requires an externally manipulated button to actuate the latch for either attaching or removing the antenna.

Another type of latching mechanism uses a simple key shape molded into the antenna and a keyhole feature molded into the utility's body. This provides positive latching throughout most of the antenna's rotational travel, but depends on friction to hold the antenna in place as the key and keyhole line-up when the antenna is rotated around.

Therefore, a need exists for a latch detent mechanism, with a minimum of parts, that provides a positive latch while still allowing simple removal. Also, a reduction in size over either of the above described devices is desirable. Accordingly, it is highly desirable to provide apparatus which overcomes these problems and which is inexpensive and easy to install and use.

BRIEF DESCRIPTION OF THE DRAWINGS

Referring to the drawings.

DESCRIPTION OF THE PREFERRED EMBODIMENT

Figure 1:
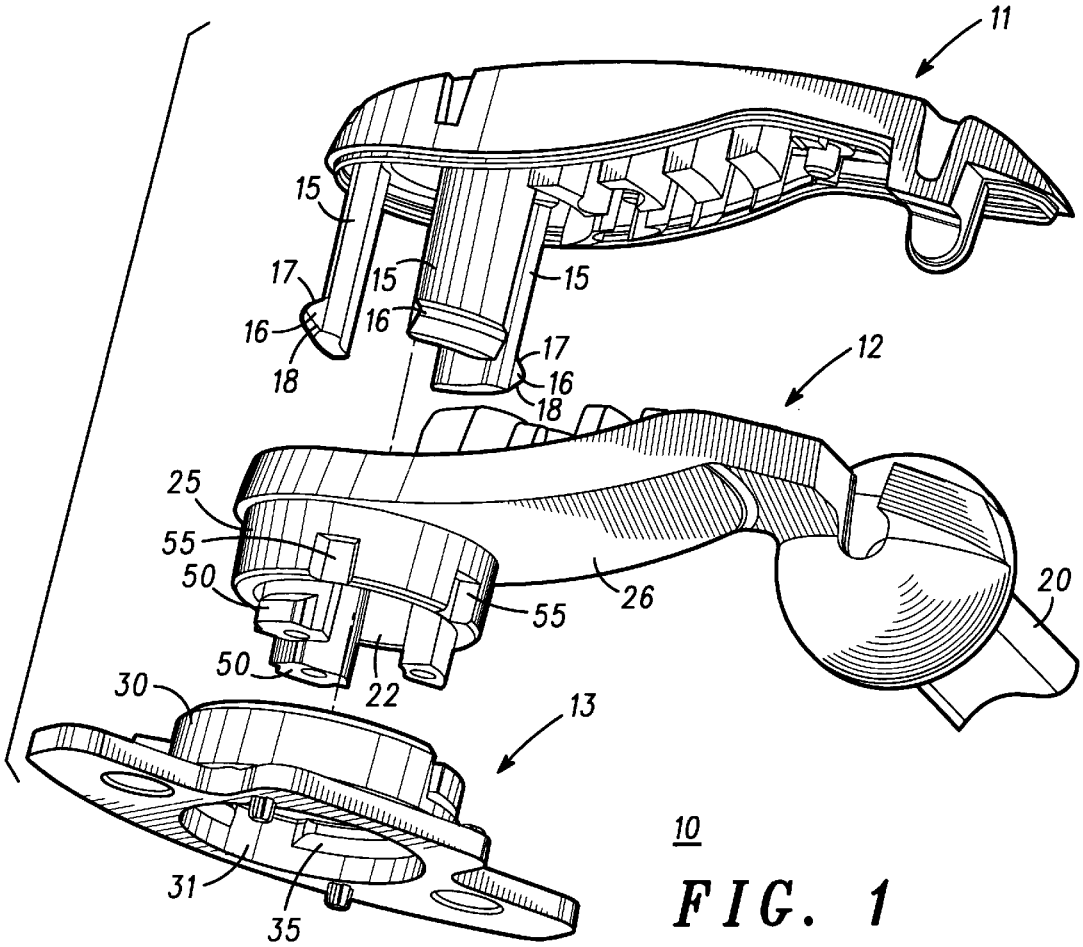
FIG. 1 is an exploded isometric view of a cover, housing, and mating utility part, in accordance with the present invention.

Turning now to the drawings, in which like components are designated with like numbers throughout the several views, FIG. 1 illustrates an exploded view of an antenna latching mechanism, generally designated 10 which includes a cover 11, a housing 12, and a mating utility part 13, in accordance with the present invention. A plurality of flexible fingers 15 (three in this embodiment) are each connected at one end to an inner surface of cover 11 and each downwardly projecting finger 15 has an outwardly projecting cam surface 16 formed adjacent a lower end. Cam surfaces 16 each have an upper beveled or sloping surface 17 and a lower oppositely beveled or sloping surface 18. As will be explained in more detail presently, cam surfaces 16 are constructed for easy assembly and disassembly of antenna latching mechanism 10.

Housing 12 has a generally oblong shape and has an antenna 20 fixedly attached thereto adjacent one end. Antenna 20 extends outwardly from housing 12 generally in the plane of housing 12. An opening 22 is defined through housing 12 adjacent the other end, and is formed to allow fingers 15 of cover 11 to be inserted therethrough, as will be explained in more detail presently. A stem 25 is formed on housing 12 generally encircling opening 22 and extending outwardly (downwardly in FIG. 1) from an outer or lower surface 26 of housing 12. A mating collar 30 is formed on mating utility part 13 so as to encircle an opening 31 through mating utility part 13. Stem 25 on housing 12 is designed to mate with and rotatably fit within collar 30 on mating utility part 13. As will be understood, mating utility part 13 is designed to be fixedly attached to a utility, such as a telephone, radio, etc.

Figure 2:
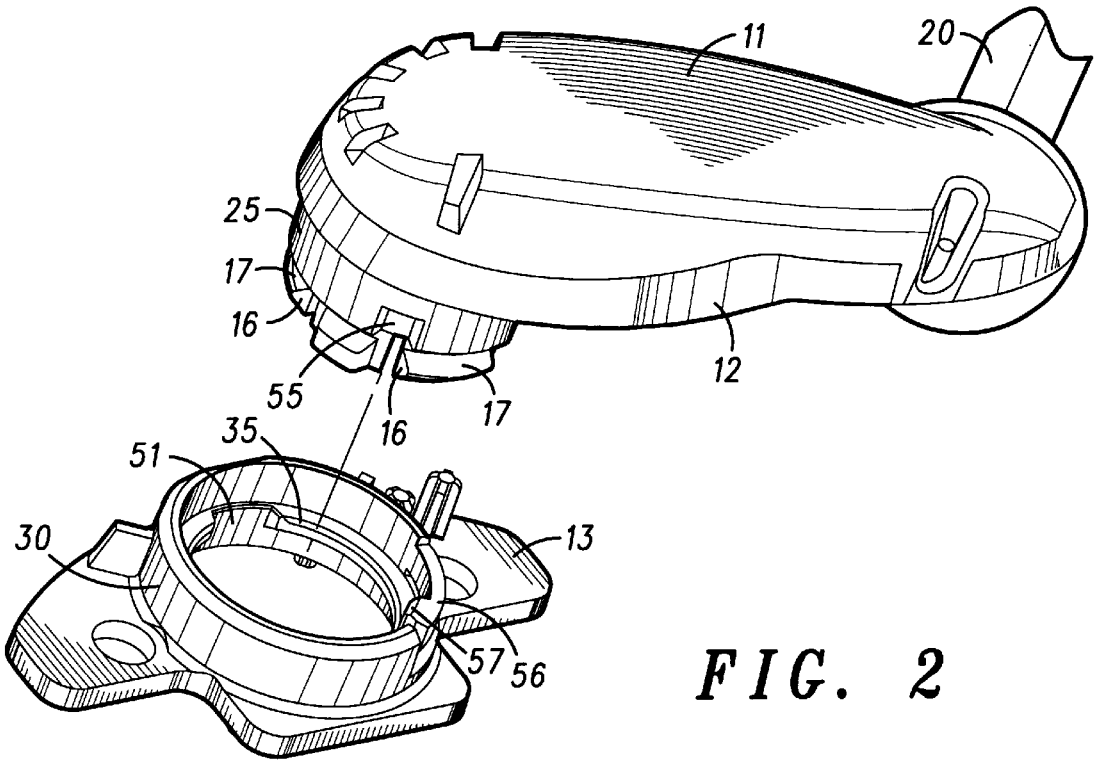
FIG. 2 is an exploded isometric view of the apparatus of FIG. 1 in a partially assembled orientation.

Referring additionally to FIG. 2, cover 11 is illustrated in a partially assembled orientation with housing 12. Because flexible fingers 15 are constructed to flex radially inwardly and because cam surfaces 16 have lower beveled surface 18, flexible fingers 15 can be readily inserted into opening 22 for easy assembly of antenna latching mechanism 10. Also, because cam surfaces 16 have upper beveled surfaces 17, flexible fingers 15 can be readily withdrawn from opening 22 of housing 12 for easy disassembly.

An inwardly directed ridge 35 is formed on the inner surface of collar 30 in opening 31. Mating utility part 13 and ridge 35 are positioned so that flexible fingers 15 extend through opening 31, with stem 25 coaxially positioned in collar 30, and beveled surfaces 17 of cam surfaces 16 on flexible fingers 15 engage the opposed (or lower) surface of ridge 35 in a releasable assembled orientation. As explained above, because of the flexibility of fingers 15 and upper and lower beveled surfaces 17 and 18, respectively, of cam surfaces 16 cover 11, housing 12, and mating utility part 13 can be quickly and easily assembled and/or disassembled. The specific angles of beveled surfaces 17 and 18 of cam surfaces 16 are angled to determine the amount of force needed to attach and remove the housing assembly from utility part 13. i.e. to remove the antenna from the utility. Flexible fingers 15 flex as the housing assembly is engaged and disengaged from the utility to provide a desirable "snap-in" feel.

Figure 4:
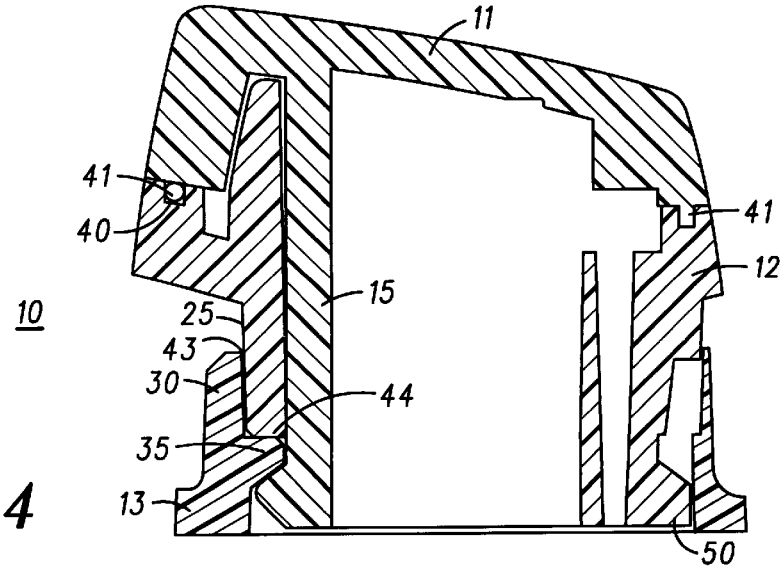
FIG. 4 is a sectional view as seen from the line 4—4 in FIG. 3.

Referring additionally to FIG. 4, a cross-sectional view of antenna latching mechanism 10 in the releasable assembled orientation is illustrated. From this view it can be seen that housing 12 mates with utility part 13 and flexible fingers 15 of cover 11 hold the entire assembly together. To provide additional water-tight integrity, housing 12 is provided with a groove 40 around the entire periphery and either a tongue 41, a gasket, or both are provided with cover 11 to ensure that no moisture can leak into the housing assembly. Also, stem 25 and collar 30 have mutual bearing surfaces defined thereon to provide relative rotation therebetween. In this specific embodiment the bearing surfaces include an outer surface 43 of stem 25 and a mating inner surface of collar 30. Also, the lower edge of stem 25 rests on and forms a bearing surface with upper surface 44 of ridge 35, as can be seen most clearly in FIG. 4. In this specific embodiment, all of the components of antenna latching mechanism 10 are formed of molded plastic and it will be understood that a sufficiently hard plastic can be used so that no undue wear will occur on the bearing surfaces. However, if desired, additional material (e.g. metal or the like) or processing can be used to further enhance the life of the bearing surfaces.

Figure 3:
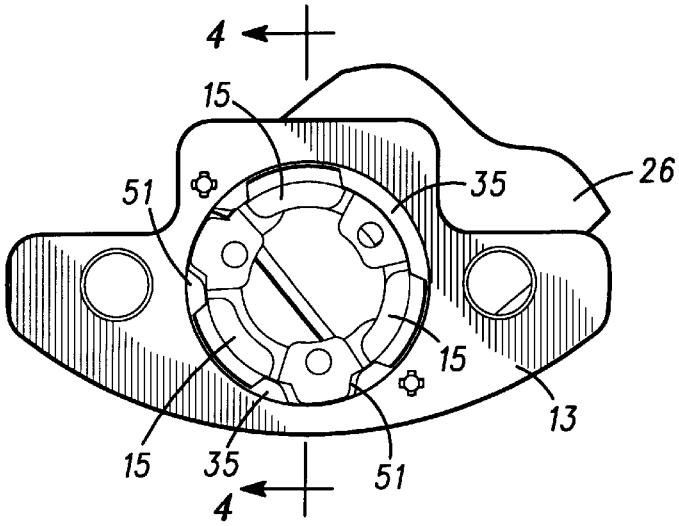
FIG. 3 is a view in bottom plan of the apparatus of FIG. 1 in an assembled orientation.

To further enhance the releasable assembled orientation of antenna latching mechanism 10 and to more solidly affix antenna 20 to the utility, one or more latch lugs 50 (two in this embodiment) are formed on housing 12 so as to extend beyond the lower edge of stem 25 (see FIG. 1). Ridge 35 in collar 30 has mating lug receiving notches 51 formed therein. In a further assembly operation, the housing assembly, including cover 11 assembled onto housing 12, is positioned so that latch lugs 50 are axially aligned with mating lug receiving notches 51 (see FIG. 3) and stem 25 is inserted into collar 30 until the lower edge of stem 25 bears against upper surface 44 of ridge 35. In this position, the housing assembly can be rotated so that the upper surface of latch lugs 50 engage the lower surface of ridge 35 and positively lock antenna latching mechanism 10 in the releasable assembled orientation.

Even when the assembly is rotated so that latch lugs 50 are again aligned with lug receiving notches 51, the assembly will be retained in the assembled position because cam surfaces 16 are still engaged with the lower surface of ridge 35. To reduce the angular positions over which the assembly is not positively locked, latch lugs 50 and lug receiving notches 51 are positioned so that there is only one position where both latch lugs 50 mate with both lug receiving notches 51. In all other positions at least one latch lug 50 is engaged with the lower surface of ridge 35 to more solidly attach the housing assembly and antenna 20 to mating utility part 13 and, hence, to the utility.

A plurality of spaced apart detent notches 55 are defined in the outer surface or periphery of stem 25 (as best seen in FIG. 1) and a mating flexible detent finger 56 is formed in collar 30. Detent notches 55 are spaced apart to provide for a plurality of different angular positions for the housing assembly, and antenna 20, relative to mating utility part 13 and, hence, to the utility. Generally, antenna 20 is coupled to the housing assembly so as to extend outwardly generally parallel to a radius of the rotatably assembled stem 25 and collar 30. Flexible detent finger 56 is positioned to engage a selected one of detent notches 55 and provide a plurality of stable axial or angular positions of the housing assembly and antenna 20 relative to mating utility part 13 and the utility. The surface of a detent 57 on flexible detent finger 56 is beveled to provide a positive detent action in conjunction with flexible detent finger 56 and detent notches 55. Both beveled sides of detent 57 have release angles which can be set to produce an appropriate detent force to provide the positive detent action. Here it should be noted that additional spring bias can be added to detent finger 56 by assembling a separate spring, of metal or the like, on the outside of collar 30 so as to bear against detent spring finger 56 and bias it inwardly, if desired.

While a specific embodiment is illustrated and described in which flexible fingers 15 are attached to cover 11, stem 25 is attached to housing 12 and collar 30 is attached to mating utility part 13, it will be understood by those skilled in the art that at least some of these components can be reversed (e.g. stem 25 attached to mating utility part 13 and collar 30 attached to housing 12) and substantially the same operation can be achieved. Also, more or less flexible fingers 15, latch lugs 50, and detent notches 55 may be utilized, if desired. In addition, while the disclosed embodiment is constructed by molding plastic, for improved operation and reduced cost, it should be understood that other methods of fabrication could be utilized in specific applications.

Thus, a new and novel antenna latching mechanism is disclosed in which the combination of all the latch and detenting functions are incorporated into simple molded features on already existing parts of the antenna and the utility. This incorporation into existing parts eliminates the need for additional parts and assemblies. Further, the new and novel antenna latching mechanism provides simple removal of the antenna from the utility without the need for actuating buttons and the like, but still maintains positive latching. The flexible fingers require the application of a disengaging force for removal, thus ensuring that the antenna cannot simply fall out even when located in the removal position.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. An antenna latching mechanism for a utility comprising:

a housing assembly having an antenna coupled thereto;

a mating utility part designed to be attached to the utility;

a collar formed on the utility part and a mating stem designed to rotatably fit within the collar and formed on the housing assembly, the collar and stem defining an opening therethrough, and a ridge formed in the opening on the collar;

a plurality of flexible fingers each having an outwardly projecting cam surface formed on a cover and positioned to extend through the opening with the stem coaxially positioned in the collar, with the cam surfaces of the flexible fingers engaging an opposed surface of the ridge in a releasable assembled orientation; and a plurality of spaced apart detent notches defined in the stem and a mating flexible detent finger formed in the collar to engage a selected one of the detent notches and provide a plurality of stable axial positions of the housing assembly relative to the mating utility part.

2. The antenna latching mechanism for a utility as claimed in claim 1 including in addition at least one latch lug formed in the stem and a lug receiving notch defined in the ridge, the latch lug being formed and positioned to pass through the lug receiving notch with the housing assembly and utility mating part in the releasable assembled orientation and to engage an opposing edge of the ridge with the housing assembly axially rotated relative to the utility mating part.

3. The antenna latching mechanism for a utility as claimed in claim 1 including two spaced apart latch lugs formed in the stem and two mating lug receiving notches defined in the ridge, the two latch lugs being formed and positioned to pass through the two mating lug receiving notches with the housing assembly and utility mating part in the releasable assembled orientation and to each engage an opposing edge of the ridge with the housing assembly axially rotated relative to the utility mating part.

4. The antenna latching mechanism for a utility as claimed in claim 1 wherein the stem and collar have mutual bearing surfaces defined thereon to provide relative rotation.

5. The antenna latching mechanism for a utility as claimed in claim 4 wherein the mutual bearing surfaces include an upper surface of the ridge and a lower edge of the stem.

6. The antenna latching mechanism for a utility as claimed in claim 5 wherein the mutual bearing surfaces further include an outer surface of the stem and an inner surface of the collar.

7. The antenna latching mechanism for a utility as claimed in claim 1 wherein the housing assembly and mating utility part are each formed of molded plastic.

8. The antenna latching mechanism for a utility as claimed in claim 1 wherein the antenna coupled to the housing assembly is affixed to the housing assembly so as to extend outwardly generally parallel to a radius of the rotatably assembled stem and collar.

9. The antenna latching mechanism for a utility as claimed in claim 1 wherein the detent notches are formed in the stem and the stem is formed on the housing assembly, and the detent finger and the ridge are formed in the collar and the collar is formed on the mating utility part.

10. An antenna latching mechanism for a utility comprising:

a housing having an antenna coupled thereto;

a cover constructed to mate with the housing, the cover having a plurality of flexible fingers each having an outwardly projecting cam surface;

a mating utility part;

a collar formed on the utility part and a mating stem designed to rotatably fit within the collar and formed on the housing, the collar and stem defining an opening designed to receive the flexible fingers of the cover therethrough, a ridge formed in the opening on the collar and positioned to engage the cam surfaces of the flexible fingers in a releasable assembled orientation with the stem coaxially positioned in the collar; and a plurality of spaced apart detent notches defined in the stem and a mating flexible detent finger formed in another of the stem and collar to engage a selected one of the detent notches and provide a plurality of stable axial positions of the housing relative to the mating utility part.

11. The antenna latching mechanism for a utility as claimed in claim 10 including in addition at least one latch lug formed in the stem and a lug receiving notch defined in the ridge, the latch lug being formed and positioned to pass through the lug receiving notch with the housing, cover, and utility mating part in the releasable assembled orientation and to engage an opposing edge of the ridge with the housing and cover axially rotated relative to the utility mating part.

12. The antenna latching mechanism for a utility as claimed in claim 10 including two spaced apart latch lugs formed in one of the collar and stem and two mating lug receiving notches defined in the ridge, the two latch lugs being formed and positioned to pass through the two mating lug receiving notches with the housing, cover, and utility mating part in the releasable assembled orientation and to each engage an opposing edge of the ridge with the housing and cover axially rotated relative to the utility mating part.

13. The antenna latching mechanism for a utility as claimed in claim 10 wherein the stem end collar have mutual bearing surfaces defined thereon to provide relative rotation.

14. The antenna latching mechanism for a utility as claimed in claim 13 wherein the mutual bearing surfaces include an upper surface of the ridge and a lower edge of the stem.

15. The antenna latching mechanism for a utility as claimed in claim 14 wherein the mutual bearing surfaces further include an outer surface of the stem and an inner surface of the collar.

16. The antenna latching mechanism for a utility as claimed in claim 10 wherein the housing, cover and mating utility part are each formed of molded plastic.

17. The antenna latching mechanism for a utility as claimed in claim 10 wherein the antenna coupled to the housing is affixed to the housing so as to extend outwardly generally parallel to a radius of the rotatably assembled stem and collar.

18. The antenna latching mechanism for a utility as claimed in claim 10 wherein the detent notches are formed in the stem and the stem is formed on the housing, and the detent finger and the ridge are formed in the collar and the collar is formed on the mating utility part.

19. An antenna latching mechanism for a utility comprising:

a housing having an antenna coupled thereto, the housing having an opening therethrough and defining an outwardly projecting stem having a circular cross-section with the opening extending through the stem, at least one latch lug projecting outwardly from the stem and a plurality of spaced apart detent notches formed in the stem;

a cover constructed to mate with the housing and including a plurality of flexible fingers projecting outwardly therefrom and positioned to extend through the opening in the stem with the housing and cover in a mating orientation, each of the flexible fingers having an outwardly projecting cam surface adjacent an end thereof; and a mating utility part including an outwardly projecting collar designed to receive the stem of the housing rotatably positioned therein, the collar of the mating utility part having an inwardly directed ridge positioned to receive the stem in rotatably sliding engagement therewith and the cam surfaces of the flexible fingers engaged with an opposed surface of the ridge to hold the cover, housing, and mating utility part in a releasable assembled orientation, a lug receiving notch defined in the ridge, the latch lug being formed and positioned to pass through the lug receiving notch with the housing, cover, and utility mating part in the releasable assembled orientation and to engage an opposing edge of the ridge with the housing and cover axially rotated relative to the utility mating part, and a flexible detent finger formed in the mating utility part and positioned to engage a selected one of the spaced apart detent notches in the stem to axially position the housing and cover in a selected rotated orientation relative to the mating utility part.

20. The antenna latching mechanism for a utility as claimed in claim 19 wherein the housing, cover and mating utility part are each formed of molded plastic.

21. The antenna latching mechanism for a utility as claimed in claim 19 including two spaced apart latch lugs formed in the stem and two mating lug receiving notches defined in the ridge, the two latch lugs being formed and positioned to pass through the two mating lug receiving notches with the housing, cover, and utility mating part in the releasable assembled orientation and to each engage an opposing edge of the ridge with the housing and cover axially rotated relative to the utility mating part.

22. The antenna latching mechanism for a utility as claimed in claim 19 wherein the stem and collar have mutual bearing surfaces defined thereon to provide relative rotation.

23. The antenna latching mechanism for a utility as claimed in claim 22 wherein the mutual bearing surfaces include an upper surface of the ridge and a lower edge of the stem.

24. The antenna latching mechanism for a utility as claimed in claim 23 wherein the mutual bearing surfaces further include an outer surface of the stem and an inner surface of the collar.

25. The antenna latching mechanism for a utility as claimed in claim 19 wherein the antenna coupled to the housing is affixed to the housing so as to extend outwardly generally parallel to a radius of the rotatably assembled stem and collar.

* * * * *